United States Patent [19]

Jarvis

[11] 4,392,455

[45] Jul. 12, 1983

[54] HEAT-SINK WATER HEATER

[76] Inventor: Raymond C. Jarvis, Millers Falls Rd., Turners Falls, Mass. 01376

[21] Appl. No.: 278,044

[22] Filed: Jun. 29, 1981

[51] Int. Cl.[3] ..... F22B 33/00

[52] U.S. Cl. ..... 122/20 A; 126/34; 126/132

[58] Field of Search ..... 126/5, 132, 31, 34, 126/101, 133; 122/20 A, 20 B

[56] References Cited

U.S. PATENT DOCUMENTS

| | | | |
|---|---|---|---|
| 633,849 | 9/1899 | Johnson | 122/20 A |
| 1,026,753 | 5/1912 | Lawrie | 122/20 A |
| 1,540,360 | 6/1925 | Mooney | 122/20 A |
| 1,669,794 | 5/1928 | Vrba | 122/20 A |

*Primary Examiner*—Edward G. Favors

*Attorney, Agent, or Firm*—Chapin, Neal, Dempsey, Fishman & Dionne

[57] ABSTRACT

A heat-sink type of water heater unit is disclosed wherein the unit is designed for external installation on a stove to transfer heat from the stove to water flowing through the unit, to pre-heat the water for subsequent use. The unit has a flat surface which can be bolted to the outside of the stove, an inlet which can be attached to a cold-water source, a U-shaped inner passage in which water can flow and be heated by the stove, and a discharge which can be hooked up to a hot-water tank. In addition, the unit has an adjustment feature which enables the unit to be moved laterally, closer to or farther away from the hot stove wall to which the unit is connected. By regulating the distance between the unit and the stove, the water temperature produced by the unit can be selectively controlled.

6 Claims, 4 Drawing Figures

HEAT-SINK WATER HEATER

BACKGROUND OF THE INVENTION

The present invention relates to water heating systems attached to coal-burning or wood-burning stoves in which the heat from the stove is utilized to raise the temperature of the water used for household and other purposes, the process being called "indirect heating" by those skilled in the art.

Some prior hot-water systems use auxilliary piping in conjunction with a stove to transfer heat from the stove to water flowing through the piping. While these systems heat water economically by using heat recovered from the stove, these systems have serious drawbacks. For example, the hot-water system of U.S. Pat. No. 567,593 to Hallowell employs a water-back or heating pot which is located inside the stove, next to the stove's coiled firepot. The location of the water-back makes the system difficult to install and service. Further, the water temperature produced by the Hallowell system cannot be regulated without raising or lowering the heat of the stove itself, i.e., by changing the fuel consumption, or by installing additional hardware to shield the firepot to lower the water temperature.

In view of the recent energy crisis and the attendant rise in home heating costs, wood-burning stoves have enjoyed a revival in their use as home heating systems. Accordingly, it is a principal object of the present invention to provide a novel water-heater system with a heat-sink module that can be easily attached to an external wall of a wood-burning stove to transfer heat from the stove to water flowing through the module, to preheat the water for subsequent household use.

It is another object to provide the heat-sink module with a simple control knob to regulate the water temperature produced by the system.

It is yet another object to provide a water-heater system, commensurate with the above-listed objects, which can be used as either the principal hot-water system or as a means to augment an existing system.

It is a further object to provide a heat-sink module that is inexpensive and easy to install, yet safe and effective to use.

The above and other object and advantages of this invention will become more readily apparent when the following description is read in conjunction with the accompanying drawings.

DETAILED DESCRIPTION OF THE PREFERRED EMBODIMENTS

Figure 1:
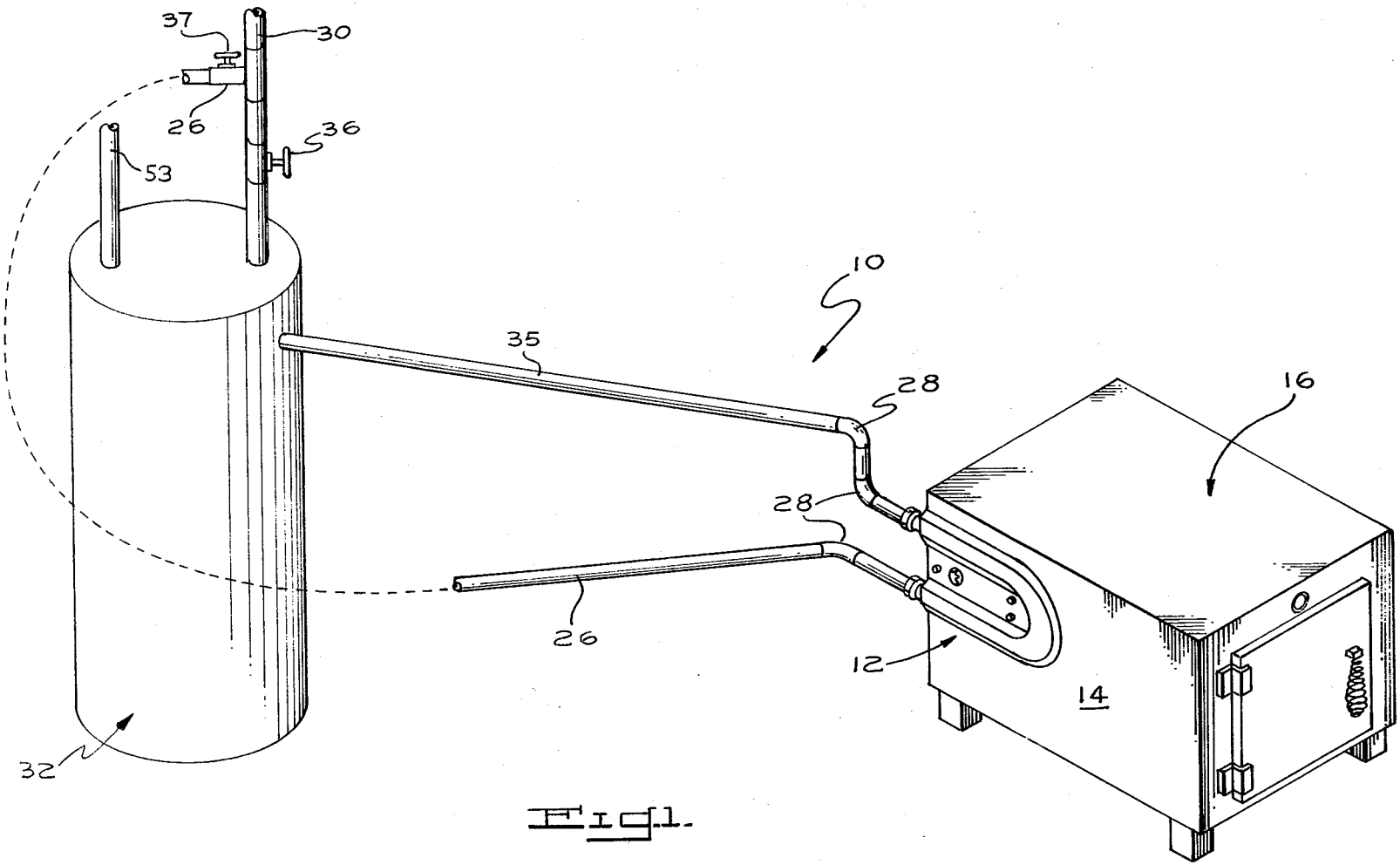
FIG. 1 is a perspective view of a water-heating system constructed in accordance with the present invention.

Referring to the drawings in detail, a water heating system is shown in FIG. 1 and generally designated by the reference numeral 10. The system includes a heat-sink module 12 which is attached to an outer wall 14 of a stove 16 to transfer heat from the stove to water flowing through an inner passage 18 of the module.

Figure 2:
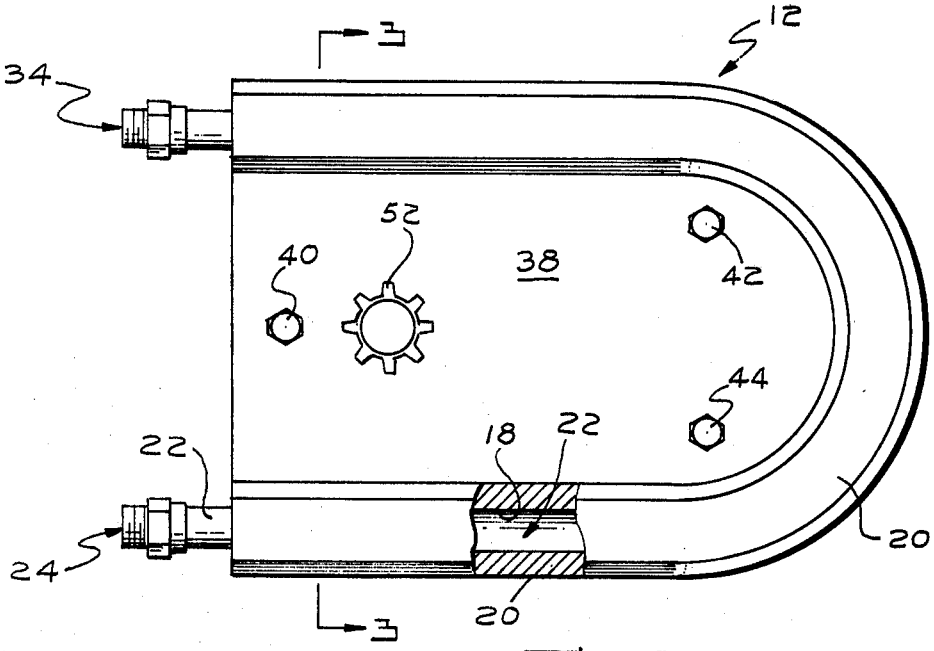
FIG. 2 is a front plan view, with portions broken away, of a heat-sink module used in the FIG. 1 system.
Figure 3:
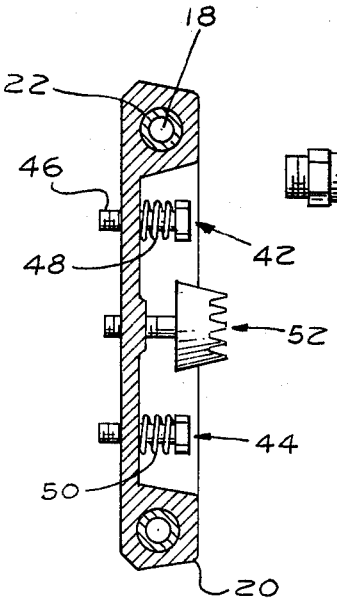
FIG. 3 is a cross-sectional view taken along line 3—3 of FIG. 2.
Figure 4:
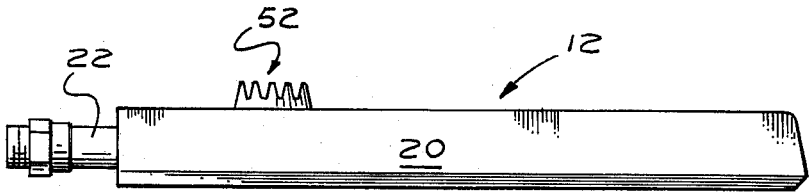
FIG. 4 is a side plan view of the module shown in FIG. 2.

As best shown in FIGS. 2–4, the heat-sink module 12 is made of any suitable heat-absorbing metal, such as aluminum. The preferred module 12 is an aluminum casting 20 having an embedded U-shaped copper pipe 22 which forms the passage 18 through which water can flow and be heated by the stove. Pipe 22 has a threaded end portion or inlet 24 that can be connected via suitable piping 26 and connectors 28 to a cold-water source, such as the inlet line 30 of a conventional hot-water tank 32 (see FIG. 1). Pipe 22 also has a threaded outlet end 34 that can be similarly connected via piping 35 to the hot-water supply of tank 32.

The system 10 is normally held off-line from tank 32 by a pair of valves 36, 37 when the stove 16 is cold and is brought on-line when the stove is hot. For example, when the stove 16 is warm enough for the system 10 to produce hot water, the system 10 is turned on-line by shutting valve 36 and opening valve 37 to bypass water from line 30 to the module 12 through piping 26. Later, when the stove becomes cold, the system 10 is brought off-line by shutting valve 37 and opening valve 36 to stop the bypass and prevent water from flowing through piping 26. Otherwise, cold water would flow through the system 10 and into the hot-water supply of tank 32.

As best shown in FIGS. 1–3, the module 12 has a relatively flat surface or plate 38 that can be bolted or clamped to the stove wall 14. In the illustrated embodiment, the module is attached to the stove by three spring-biased bolts 40, 42, 44. Each of the bolts has a threaded stem portion 46 and an unthreaded portion 48 which fit through a smooth bore in the surface 38. The unthreaded stem portions have springs 50 which bias the flat surface 38 against the stove wall 14 but also permit the flat surface to be moved laterally to the wall, i.e., to the right or left as viewed in FIG. 3.

The spring-biased bolts 40, 42, 44 act in conjunction with an adjustable control knob 52 to move the module closer to or farther away from the stove wall 14, and thereby selectively control the amount of heat transferred from the stove to the water passing through the module. By turning the knob 52 in a clockwise direction, a threaded stem 54 of the knob travels through a threaded bore 56 in the flat surface and pushes against the stove wall 14 to overcome the biasing effect of springs 50 and move the flat surface 38 away from the wall. By turning the knob counterclockwise, the stem 48 retreats and the springs push the module closer to the stove wall. Thus, the control knob 52 can be used to easily regulate the water temperature produced by the module 12.

In another preferred embodiment of the present invention (not shown), the piping 26 is connected to the drain pipe of the hot-water tank 32 rather than to the inlet pipe 30. Further, the piping 35 is connected to the hot-water line 53 of tank 32 (rather than to the tank's supply) and has a valve to shut off the flow of water through the system 10 when the stove 14 is cold. The external connection of piping 35 to line 53 permits the system to be hooked up to a standard hot-water tank 32 without the need of drilling a hole in the tank to provide a flow of pipe 35 into the tank's hot-water supply. Moreover, if the main heating source for the tank 32 is turned off (e.g., electricity), the connection of piping 26 to the drain pipe ensures that any cooled water in the tank supply will be heated by the module 12.

While two preferred embodiments of the present invention have been expressly disclosed, it should be understood that obvious structural modifications can be made without departing from the spirit of the invention. For example, a set screw (not shown) can be used in lieu of the control knob 52 to adjust the distance between the flat surface 38 and the stove wall 14. Further, although the water-heating system 10 is shown in connection with a hot-water tank 32, it should be understood that the system 10 can be used instead to supply hot water in a home-heating system (not shown). Accordingly, reference should be made primarily to the accompanying claims, rather than to the description of the preferred embodiments, to determine the scope of the invention.

Having thus described the invention, what is claimed is:

1. A water heater comprising:

(a) a heat sink module having a relatively flat surface and a passage for fluid flow;

(b) said passage having an inlet connectable to a water source and a discharge connectable to a hot water line;

(c) means for attaching said module to an external wall of a stove to transfer heat from the stove to water flowing through the passage wherein said flat surface of said module is disposed substantially parallel to said external stove wall, and, (d) adjustment means for selectively moving said module away from or closer to said external stove wall to regulate the amount of heat transferred from the stove to the module and thereby control the water temperature produced by the heater.

2. The water heater of claim 1 wherein the adjustment means includes a plurality of springs that bias the module toward the external stove wall and an adjustment screw to force the module away from the external stove wall.

3. The water heater of claim 1 wherein the passage is substantially U-shaped.

4. The water heater of claim 1 wherein the module is made of metal.

5. A water heater comprising:

(a) a heat-sink module having a cast aluminum body with a relatively flat surface that is designed for attachment to an external wall of a stove;

(b) said module having a generally U-shaped inner passage defined by a copper pipe;

(c) said pipe having an inlet end and a discharge end;

(d) means for attaching the flat surface to an external wall of a stove to transfer heat from the stove to water flowing through the passage; and (e) an adjustment means for selectively moving the flat surface away from or closer to said stove wall to regulate the amount of heat transferred from the stove to the module and thereby control the water temperature produced by the heater.

6. The water heater of claim 5 wherein the adjustment means includes a plurality of springs that bias the flat surface of the module toward the stove wall and an adjustment screw to force the flat surface away from the stove wall.

* * * * *